US005829748A

United States Patent [19]

Moore, Jr.

[11] Patent Number: 5,829,748

[45] Date of Patent: Nov. 3, 1998

[54] METHOD OF PLAYING A DICE GAME

[75] Inventor: Naif M. Moore, Jr., Mobile, Ala.

[73] Assignee: Four The Money, Inc., Birmingham, Ala.

[21] Appl. No.: 572,026

[22] Filed: Dec. 14, 1995

[51] Int. Cl.[6] ..... A63F 9/04

[52] U.S. Cl. ..... 273/274; 273/309

[58] Field of Search ..... 273/274, 309, 273/292

[56] References Cited

U.S. PATENT DOCUMENTS

| | | | |
|---|---|---|---|
| D. 122,038 | 8/1940 | Toombs | D21/25 |
| D. 344,767 | 3/1994 | Wesselmann | D21/41 |
| 3,533,627 | 10/1970 | Deffenbaugh et al. | 273/261 |
| 3,829,098 | 8/1974 | Umminger | 273/249 |
| 4,047,719 | 9/1977 | Sajkovic | 273/287 |
| 4,247,114 | 1/1981 | Carroll | 273/274 |
| 4,345,761 | 8/1982 | China | 273/146 |
| 4,362,303 | 12/1982 | Pell | 273/274 |
| 4,573,688 | 3/1986 | Grimes | 273/241 |
| 4,743,025 | 5/1988 | Gramera | 273/146 |
| 4,940,241 | 7/1990 | Faraci, Jr. | 273/261 |
| 5,026,068 | 6/1991 | Weisser | 273/241 |
| 5,133,559 | 7/1992 | Page | 273/274 |
| 5,261,671 | 11/1993 | Wyatt | 273/249 |
| 5,265,009 | 11/1993 | Colavita | 364/410 |
| 5,265,881 | 11/1993 | Doherty | 273/274 |
| 5,308,081 | 5/1994 | Bartle | 273/274 |
| 5,350,175 | 9/1994 | DiLullo et al. | 273/146 |
| 5,413,351 | 5/1995 | Franklin | 273/274 |
| 5,487,547 | 1/1996 | Hobert | 273/274 |
| 5,490,670 | 2/1996 | Hobert | 273/138.2 |

FOREIGN PATENT DOCUMENTS

| | | |
|---|---|---|
| 442132 | 8/1991 | European Pat. Off. . |
| 2364674 | 5/1978 | France . |
| 2521021 | 8/1983 | France . |
| 2562435 | 10/1985 | France . |
| 672436 | 11/1989 | Switzerland . |

OTHER PUBLICATIONS

Finite Mathematics For Management, Life and Social Sciences, Raymond A. Barnett, Dellen Publishing Company, pp. 264–294, 1979.

Sic–Bo, Chinese Game, Tripp Plastics, Oct. 1994.

*Primary Examiner*—Benjamin H. Layno

[57] ABSTRACT

A dice-type game utilizing preferably two dice which utilizes the concept of multiple rolls of numbers without hitting a target number for winning. It differs from traditional craps in that there is no requirement of a repeated number roll for a win to occur. In the preferred embodiment, a number other than seven, the target number, can be rolled on two six sided dice numbered on sides from 1–6 four consecutive times to win the main wager. Other wagers may be made which would enhance the enjoyment of the game and allow for continuous play while waiting for the four in a row wager to win. These games include rolling all numbers other than the target number before the target number is rolled; multiple rolls in excess of four without a target number; payout related to rolls of doubles, don't bets place bets and bets that a target roll will be made before the roll of certain numbers. A progressive jackpot may be provided on the game as by providing a payoff to those players on the initial Four the Money Wager where all combinations other than a 7 are rolled prior to rolling a seven. This particular jackpot is a fraction of the entire jackpot and may be financed according to a specific bet made by every player when they sit at the table. A new game table in several embodiments is disclosed in order to practice this invention. bases winning on one of the different games.

32 Claims, 7 Drawing Sheets

METHOD OF PLAYING A DICE GAME

This is a continuation in part of the provisional patent by the same inventor filed as case: Ser. No. 60/003856 filed Sep. 15, 1995 by N. M. Moore, Jr. It is also a formal patent based on the disclosure statement filed as 380420.

BACKGROUND OF INVENTION

The invention relates generally to dice games utilizing two sets of dice generating numbers between two and twelve.

GENERAL DESCRIPTION OF THE INVENTION

Aside from traditional craps, several games generally disclosing the roll of dice in obtaining winning combinations exist. The present game differs from traditional games in the provision of a target number, preferably 7, and allowing for a win when any number of rolls over a specified minimum number, preferably 4, are made without rolling the target number. Certain numbers may be excluded in determining the specified minimum number. Side games, all based on avoidance or attainment of a number of rolls or certain rolls during the period between the initial roll and the target roll may be made. These may be similar to those wagers available in traditional dice games based around either one roll or two rolls of a single number prior to rolling a seven.

A new dice game having as the principal feature a method of winning tied to having a significant number of dice rolls sequentially without a particular dice roll is described.

For example, the number of times that the dice are rolled before a seven would be the basis of winning in the preferred embodiment. Similarly, in other embodiments the number of rolls before a six or eight was rolled would be the method of determining when a win occurs. Only the statistical odds need be changed for these games.

Since the rolls are monitored in terms of the number of rolls before a specific combination, a modification of the game includes making payout when a single number is rolled a multiple number of times with the additional possible limitation of being rolled a certain number of times before a seven or other combination such as seven, six and eight is rolled. Peat and Repeat, Different Doubles, and normal place bets along with the other disclosure below reflect methods of practicing these side bets.

The game utilizes a standard dice in the preferred embodiment which is a six-sided dice having the numbers one through six represented individually, one on each face of the dice.

This can be readily be seen the game could be modified in order to use more than two dice in applying statistics to the game in order to modify the game without leaving the basic concept of multiple rolls for the rolling of one or more numbers which is disclosed herein.

In order to determine the relative odds for a payout and in order to determine what is a fair number of rolls necessary in order to justify a win, statistics are applied to the probability of rolling multiple times before a target is rolled. For example, you could have four rolls prior to the roll of a seven or five rolls prior to the roll of a six or eight without leaving the basic embodiment of the game.

The present game differs from conventional craps in that in conventional craps repeats of numbers has a set payout. Under the terms of the present game only multiple rolls of certain numbers prior to the roll of a seven results in a payout. Although, the statistics have been available for the probability of this for some time the application of this to a specific game is not found in the prior art.

It is therefore an object of this invention to provide for a dice game allowing for continuous play centered around the rolling of a target number which does not require a repetitive roll of a given number for winning or losing the primary wager.

It is another object of the game to provide for a dice game allowing for true odds to be taken prior to establishing a point by rolling a number.

It is another object of the game to provide for odds bets to be taken based on a multiple of the primary wager based on the number of repetitions before reaching a target number.

It is another object of the invention to provide a game having added excitement for all players by having payout based on statistically remote outcomes.

It is a further object of the invention to provide for a dice game having a jackpot payout.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein:

FIG. 3*b* is a detail of the betting location indicated as 3*b* in FIG. 3.

DETAILED DESCRIPTION OF THE PREFERRED EMBODIMENT

I. "FOUR THE MONEY WAGER"™ Game

Figure 1:
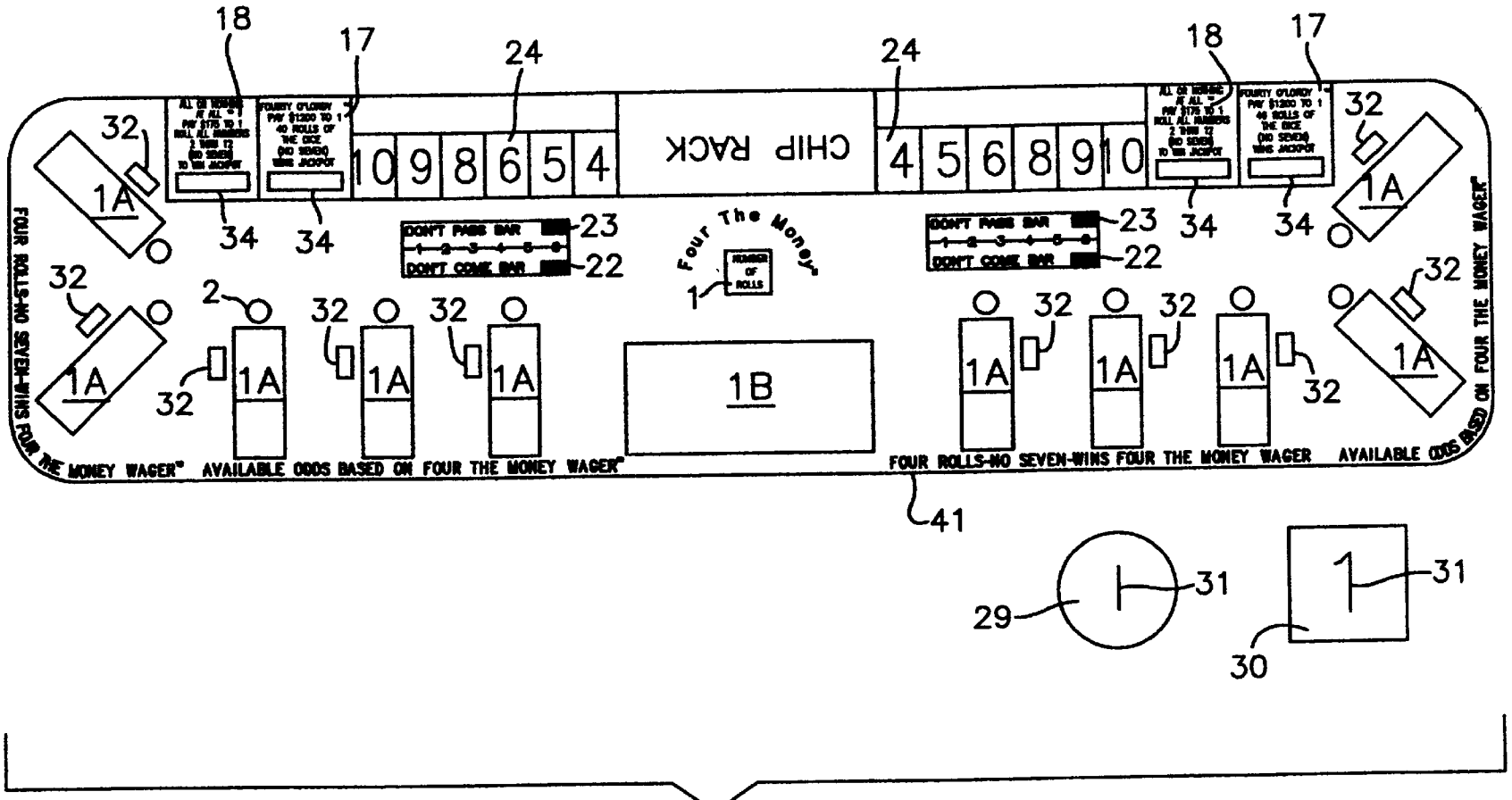
FIG. 1 is a plan view the invention showing the preferred embodiment.
Figure 1A:
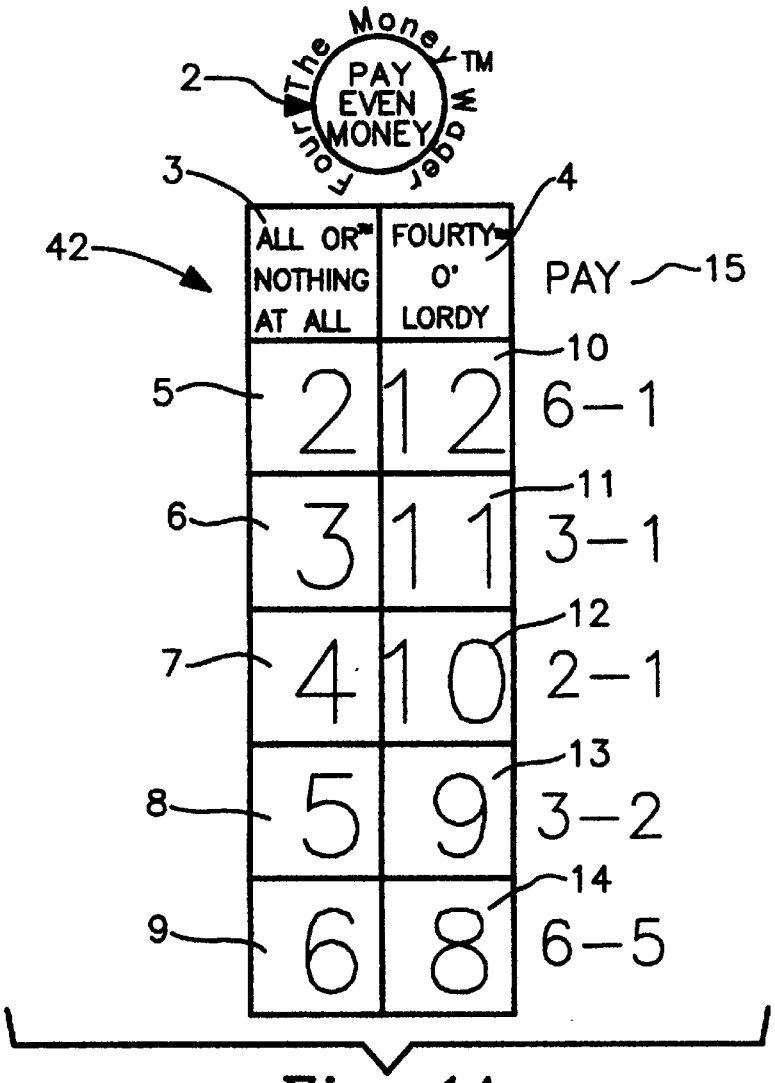
FIG. 1*a* is a detailed drawing of the betting locations indicated as 1*a* in FIG. 1
Figure 1B:
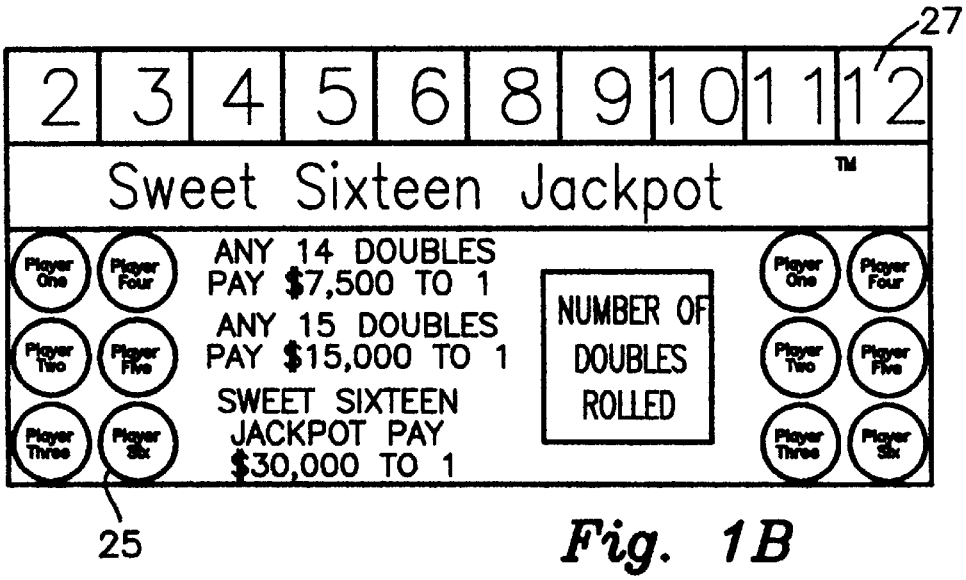
FIG. 1*b* is a detail of the betting location shown in FIG. 1.
Figure 2:
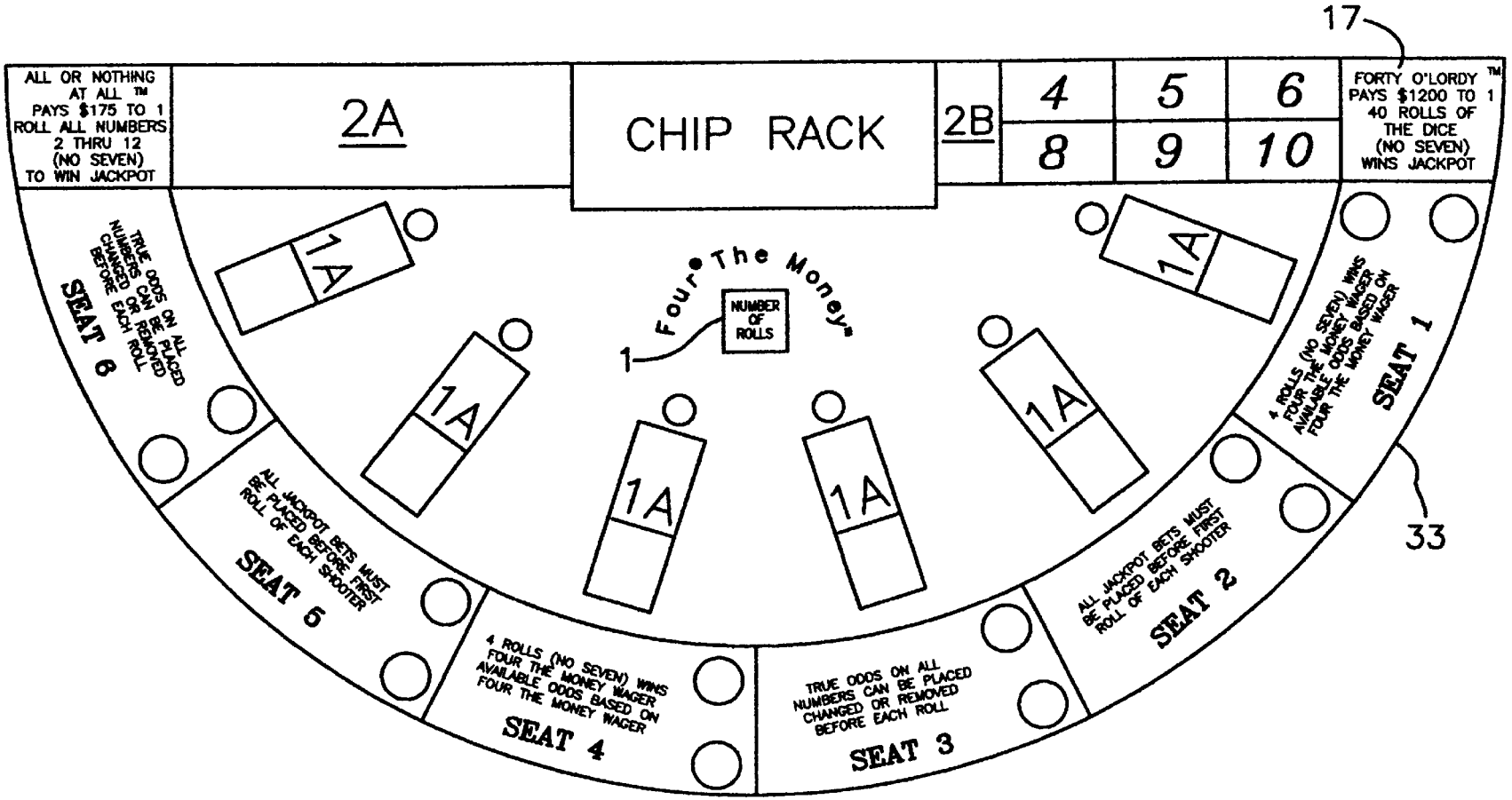
FIG. 2 is an alternate embodiment of the invention shown in FIG. 1.
Figure 2A:
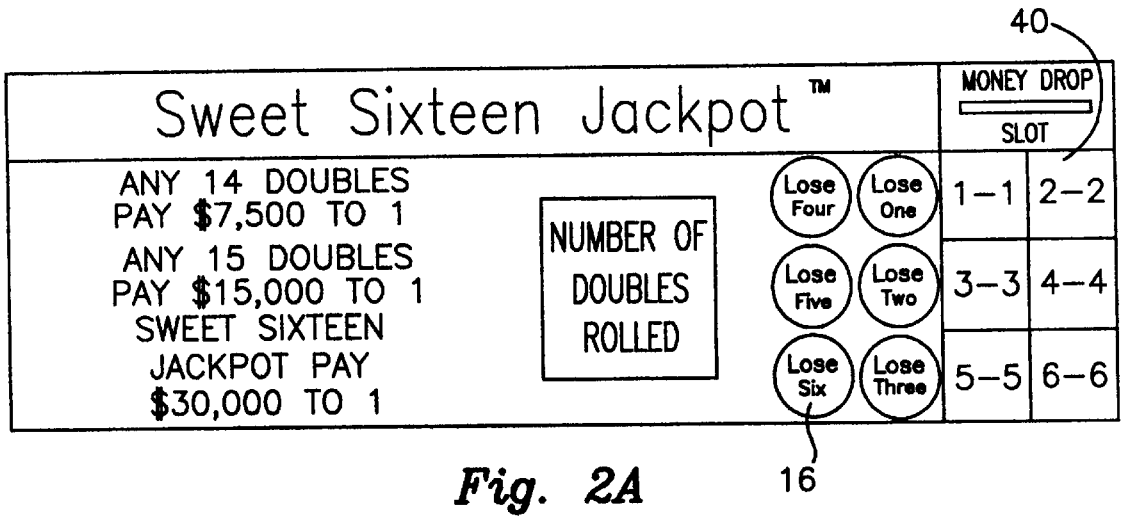
FIG. 2*a* is a detailed drawing of the betting locations indicated as 2*a* in FIG. 2
Figure 2B:
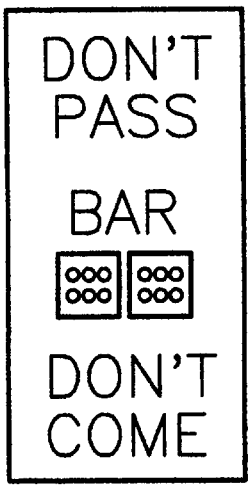
FIG. 2*b* is a detail of the betting location shown in FIG. 2.

As can best be seen by reference to FIG. 1 and FIG. 2 as well as FIGS. 1*a* and 1*b* and FIGS. 2*a* and 2*b*, the game may be played in a standing version, FIG. 1, or a sitting version, FIG. 2. Play is initiated by generating a random number between a preset minimum and a preset maximum. This is done in the preferred embodiment with traditional two six sided dice analysis. Two random numbers are therefore generated between one and six and totaled to determine the value of the number generated giving rise to various odds based on the percentage possibility of any given combination.

In the preferred embodiment, there is a target number 20 (not shown) selected as the number seven since it is the most likely number. A target of a different number or multiple different numbers, for example six and eight, could also be selected within the disclosure embodied herein. Under such circumstances, the payout odds would need to be modified according to the relative probability of these multiple target numbers being generated prior to the consecutive number described in more detail below being reached.

A money location 2 for a "FOUR THE MONEY WATER™" is provided for the initial even money bet that has to be made to qualify a player to play true odds bets in each new round of the game "FOUR THE MONEY"™. A counter display 1 is provided to show how many consecutive rolls are made prior to encountering the target number 20 (not shown).

The winning or losing of a money wager placed on the money location 2 is based solely on whether or not a seven, the target number, appears within a consecutive number of rolls, in the preferred embodiment four rolls. This determination is not influenced by any other action or bets on the table. A money wager is made on the money location 2, a random number is generated, typically by rolling the dice, and a win occurs if the random number generator or 'shooter' rolls the dice four times, thereby reaching the consecutive number four, without a seven appearing. If a seven does appear on the 1st, 2nd, 3rd or 4th roll all money wagers made on the money location are lost.

If the shooter rolls the dice all four times without a seven appearing all money wagers made on money locations automatically win.

All other numbers (2,3,4,5,6,8,9,10,11,12) that can appear on a pair of dice, shown as odds bets 3–14 (all numbers except seven), may apply towards the task of making four rolls of the dice without a seven showing. The minimum number possible is two. The maximum number possible is 12. Similarly, only some of these numbers may apply to making the consecutive number. For example, 2 and 12 could not be counted in one embodiment in arriving at the consecutive number. The remaining numbers, 3–6 and 8–11, would be the count numbers..

As each successive roll of the dice is made the number displayed on the counter display 1 increased from zero upward. A maximum number of rolls, for example 99, may be assigned in order to avoid a situation where a statistically remote event would otherwise allow for indefinite play. In the preferred embodiment this maximum number is fourty. When this maximum consecutive number is reached, all wagers would be paid and the counter 1 would be reset to zero. In the preferred embodiment, the maximum consecutive number would be forty.

A money wager typically would pay even money. The true odds of a seven appearing in four in the preferred embodiment are 1.0736 to 1. The percent of profit to the house under this scenario is 3.55%.

A money wager on the money location 2 is the initial even money bet that has to be made to qualify a player to participate in odds bet.

The winning or losing of this wager is based solely on whether or not a seven appears within four rolls and is not influenced by any other action of bets on the table. To win this wager the shooter rolls the dice four times without a seven appearing. If a seven does appear on the 1st, 2nd, 3rd or 4th roll all "FOUR THE MONEY WAGERS"™ Lose. The wagers placed on the money location 2 are removed and kept for the house. If the shooter rolls the dice all four times without a seven appearing all "FOUR THE MONEY WAGERS"™ automatically win and payout are made on the money location 2.

In the preferred embodiment there is a table which has at least one money wager. In the preferred embodiment a bet is placed on this money location to bet on four rolls in a row. A separate money wager may be provided for bets where it required five rolls in a row in order to win.

It could be determined whether or not a payout would occur on the come out rolls either with the rolling of a seven or eleven or whether there would be no payout on these unless there was a four in a row roll for the four in a row come out bet.

A "FOUR THE MONEY WAGER"™ pays even money. The true odds of a seven appearing in four at 1.0736 to 1.

ODDS BETS

The game also incorporates true odds bets wherein a bet is placed on a number. These are not standard place bets or odds bets as used in craps based on the statistical significance of a single number being rolled prior to a seven being rolled. One improvement of this game over traditional craps is that odds bets may be made in conjunction with a money wager before a 'point' or number bet is made. This is because repetitions of a single number are not required, only multiple occurrences of any number other than the target number in order to win the initial four the money wager on the money location 2.

The odds bets are based on a multiple (1 upward) of the amount placed on the four the money wager. Hence a table providing for five times odds would allow a twenty five dollar odds wager on an odds location 5–14 where a five dollar wager was made on the money location 2.

This element of uniqueness of this game allows any player to take true odds on all the odds numbers before making their first roll. These true odds bets are made on the odds locations 5–14. If a number other than seven is rolled, the dealer pays out next to the place location corresponding to the number rolled.

The odds are shown in the odds column 15 next to each set of place bets. Hence, if a place bet is made on the place location 5 or 10 corresponding to a dice roll of two (or twelve) and a two (or twelve) is rolled, a payout of six to one is made. That is six dollars would be paid for each one dollar wagered on the two location 5 (or twelve location 10). If a seven is rolled before the rolling of the odds location 5–14, the odds location wager would be lost and removed by the 'house'.

The odds shown on the pay line 15 are shown on the following table:

| | |
|---|---|
| 2 AND 12 PAY 6 TO 1 | TRUE ODDS 6 TO 1 |
| 3 AND 11 PAY 3 TO 1 | TRUE ODDS 3 TO 1 |
| 4 AND 10 PAY 2 TO 1 | TRUE ODDS 2 TO 1 |
| 5 AND 9 PAY 3 TO 2 | TRUE ODDS 3 TO 2 |
| 6 AND 8 PAY 6 TO 5 | TRUE ODDS 6 TO 5 |

On the table, place locations 5–14 group these numbers together according to the respective odds of making a given bet.

Place bets for the other numbers could also be provided which would play true odds for each of those numbers obtained. This way the subject game could be incorporated completely or in part with a pre-existing craps game.

Forty O'Lord'y™

Another feature in the game is the progressive betting associated with successive rolls after the first four without a seven. Successively higher payout or progressive payout may be made as multiples higher than four are made. One method of accomplishing this is to have a payout if fourty rolls are encountered without a seven. A Forty wager, in the preferred embodiment, yields a 1200 to one payout as shown in the forty display 17 shown on FIG. 1. Chips indicating how may rolls have been made (one chip for each roll, for example) may be placed on this location to supplement the numeric display 1.

The winning or losing of this Wager is based solely on the number of rolls made prior to a seven appearing. Players may be given a choice of betting on 10, 20, 30 or 40 rolls prior to a seven appearing.

In the preferred embodiment a 4×4" electronic light 1 will record the number of rolls made by each shooter prior to a seven appearing. Another example of how this can be done would be:

| | | |
|---|---|---|
| (1) 10 ROLLS NO SEVEN | PAY 5 FOR 1 | TRUE ODDS 5.19 T0 1 |
| (2) 20 ROLLS NO SEVEN | PAY 30 FOR 1 | TRUE ODDS 37.3 TO 1 |
| (3) 30 ROLLS NO SEVEN | PAY 200 FOR 1 | TRUE ODDS 236.3 TO 1 |
| (4) 40 ROLLS NO SEVEN | PAY 1200 FOR 1 | TRUE ODDS 1468 TO 1 |

Obviously, this can also be done in multiples of 1, 2, 3, 4, etc. without departing from the inventive concept herein. These exemplary methods are shown for purposes of teaching the invention embodied herein.

SUCCESSIVELY INCREASING PAYOUTS

Similarly, successively larger payouts on money wagers may be placed at successive rolls to build excitement. For example, after ten rolls, each for the money payout may payout at a higher yield, such as 1.5 to one. In this example, at 12 rolls, instead of a dollar for dollar payout there would be a dollar and fifty cents for each dollar on the money location 2. This could hold for all the following four the money wagers or terminate or increase again. This would prevent players from coming in except on the don't pass after the first four rolls, however, and is not shown on the preferred embodiment.

Similarly, this particular provision could be allowed only with the payment of a successive wager accepted at the beginning of each roll. In this manner, at the beginning of each round (after a target seven was generated are the first time the game is played) a player would place a successive wager. This successive wager could entitle the player to jackpots or to the successively higher payouts. Other players joining in later in the roll could not participate in the successively higher payout.

One method of practicing a jackpot or successive wager proposition only available on the initiation of a game would be to provide a slot 32 for payment beside a particular player's for the money wager. If a payment was made into this slot prior to the initial roll, a light could be displayed under the money location 2 (or at any other suitable location) showing this player was entitled to either jackpots, successively higher payouts or both. One jackpot wager slot could be provided for the jackpot and a second successive wager slot could be provided for successively higher payouts. At least one slot 32 is provided for each player location 33. A jackpot display 34 may be placed at any location on or above the table for any of the jackpots described herein.

Hop Bets

One set of bets available in this game which are generally known in the prior art game of craps are hop bets on specific number combinations on a single roll. For example, the roll of a '7' on any given roll pays 4 to 1. Hop bet locations 19 are shown in an alternative embodiment shown in FIG. 3. Hop bets is a term used to describe wagers players can make that the next upcoming roll is the only determining factor as to the winning or losing of this wager.

Some examples of possible hop bets are:

| | |
|---|---|
| OVER 7 PAYS 6 TO 5 | TRUE ODDS 7 TO 5 |
| SEVEN PAYS 4 TO 1 | TRUE ODDS 5 TO 1 |
| UNDER 7 PAYS 6 TO 5 | TRUE ODDS 7 TO 5 |
| ANY CRAP PAYS 7 TO 1 | TRUE ODDS 8 TO 1 |
| ELEVEN PAY 15 TO 1 | TRUE ODDS 17 TO 1 |
| TWO PAYS 30 TO 1 | TRUE ODDS 35 TO 1 |
| TWELVE PAYS 30 TO 1 | TRUE ODDS 33 TO 1 |

All or Nothing at all™

This bet allows for the user to bet that each of a series of numbers will be rolled before a seven is rolled.

The example shown on FIG. 1 is the All or nothing location 3 which provides a payout when all the numbers other than seven, 2, 3, 4, 5, 6, 8, 9, 10, 11 and 12, are all rolled before a seven is rolled with a payout of 150 to one. An all or nothing display 18 may be used to collect bets made on the all or nothing location 3 or to display with chips bearing the numbers rolled or electronic lights showning the numbers which numbers have been rolled.

From this teaching it can be seen that excluding one or more of these numbers would not necessarily void the concept embodied herein.

Since every number rolled except the number seven is one of the ten numbers needed to complete the cycle in order to win a "ALL OR NOTHING AT ALL"™ wager this embodiment must be bet before the first roll of the dice.

The dealer must keep track of which number is rolled. In order to do this chips may be placed on numbers as they are rolled. Electronic lighting may also be used. Chips may have numbers on them to reflect how many times a number is rolled. Chips may also be used to mark the doubles as they are rolled.

The ten numbers may be shown with chips on the rolled numbers or by having the numbers electronically lit when keyed into the computer system by the dealer operating the table as they are rolled or automatically shown if the numbers are electronically generated. To win this wager a shooter must make all ten numbers before a seven appears. The true odds against making al ten numbers before a seven are 195 to 1. Player(s) are paid 150 for 1 in this example.

MATCHING BETS

One possible improvement known as matching bets allows for the house to match the average of the four the money bets and add this payout if a certain number of rolls (four, ten, forty, etc) is made consecutively without a seven. An example of how this would be done would be if a maximum matching bet was $25.00 or if the average of the four the money money wagers was $25, each time a role was made, it would be marked with a twenty five dollar token on the four the money number of rolls display 1. Hence, after four rolls, $100.00 would be on the counter display 1. If the matching bet number of rolls was four, then when this fourth roll was made, the $100.00 of the counter display would be paid out either equally or proportionally according to the amount of the four the money wager of each player. The matching bet number of rolls could be any number of rolls, for example, fourty. This would be a method of delivering a jackpot (of, for example 25 times 40 or 1000.00 when fourty consecutive rolls were made without a seven).

Similarly, by counting the number of matching bets on the table, the dealer could determine how may rolls had occurred.

DON'T COME DON'T PASS BETS

Don't pass bet locations 23 and don't come bet locations 22 are provided for two purposes. First, it allows players to come into the table after the initial four the money wager is made where multiple rolls provide enhanced payout. Second, it allows system players to play system bets. A tracking location 24 is provided in order to allow for the player's bets to be held by the house and paid according to generally accepted gambling practices.

These bets work in the same fashion that don't come and don't pass bets work with traditional craps.

As can be seen the don't bet tracking location 24 is numbered from 4 to 6 and 8 to 10. This is because all other traditional don't pass bets are either losers, ties or winners.

The odds may be the same on don't come, con't pass bets as are provided on odds bets on teh odds locations 5–14 on the money wager made on the money location 2.

COMPOSITE DIFFERENT DOUBLES™

Figure 3:
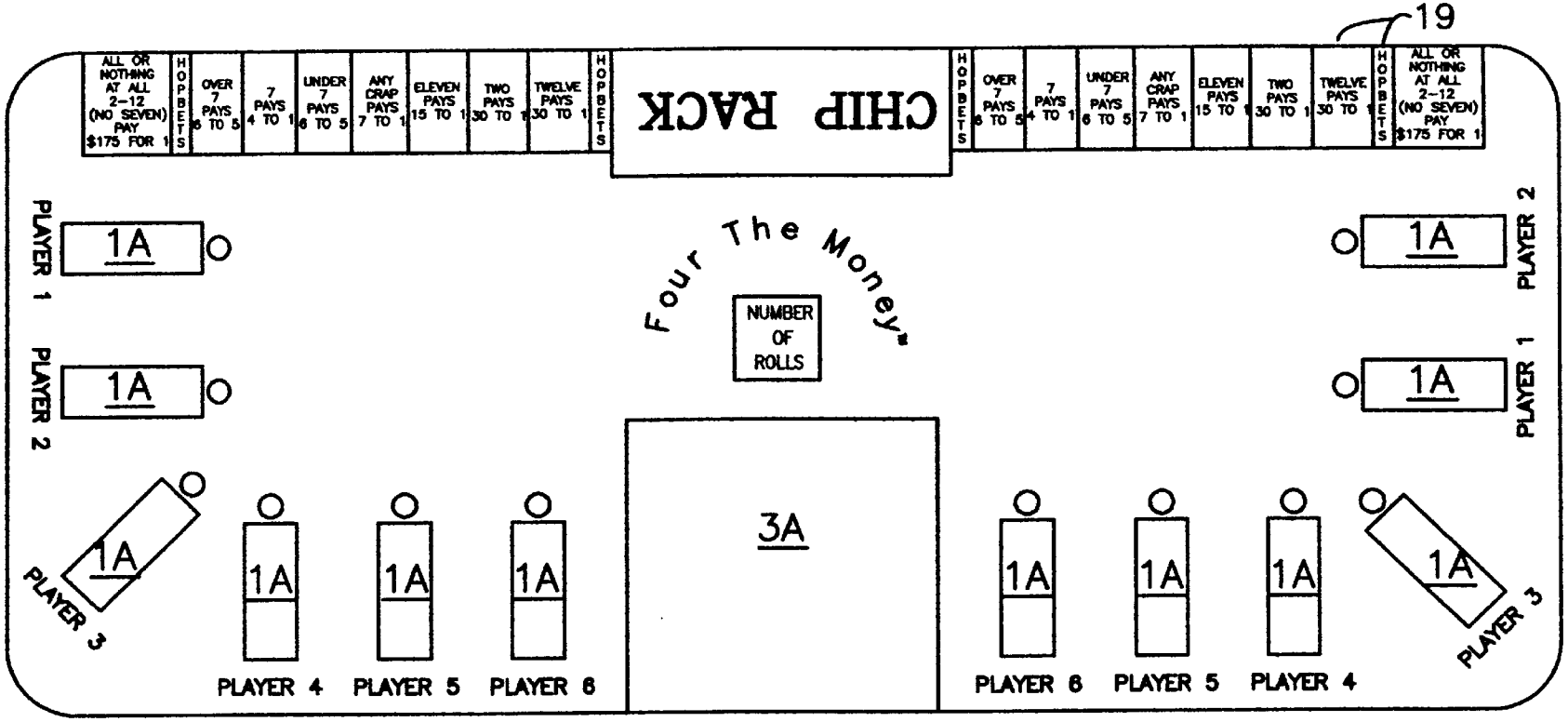
FIG. 3 is a second alternate embodiment of the invention shown in FIG. 1 providing for wagers onoccurrence of doubles.
Figure 3A:
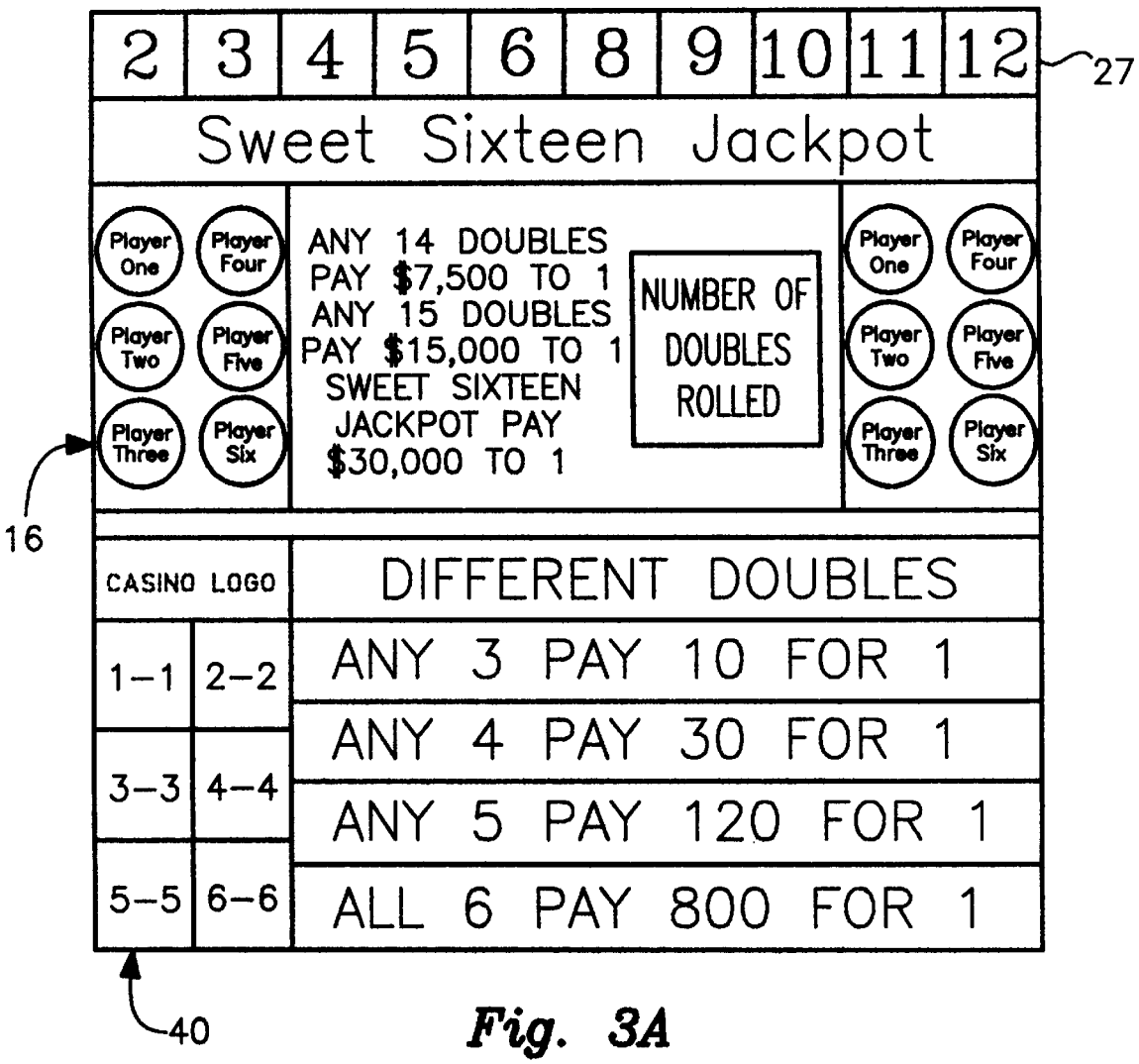
FIG. 3*a* is a detailed drawing of the betting locations indicated as 3*a* in FIG. 3

FIG. 3 shows a doubles location 16. This allows for a method of winning by rolling multiple hard ways such as three different 'hard ways' or three 'hard ways' which were the same or different being rolled prior to the roll of the seven. This location 16 for placing bets doubles as a location for a display 40 for showing the doubles generated as described in more detail herein.

The 'hard ways' as used herein merely defines the relationship whereby when two or more dice are used a number is obtained by adding the same result found on each of the dice. Hence, if the result of each dice is the numeral one and two dice were used and both results were the same you would have two ones or two. Similarly, if each of the dice results were two and you used three dice you would have a total of six.

The mechanism shown in FIG. 1 displays counters. Round counters 29 reflect non doubles. Square counters 30 are for doubles. A number 31 on either chip 29 or 30 indicates the number of times the number has been rolled. The chips have a one on one side and a two on the other side. These are placed over the numbers to show they are rolled on the tracking location 27 on FIG. 1 as each number is rolled to keep track of which numbers are rolled and which are rolled as doubles when electronic lights are not available. The table may have raised edges around each of the numbers 2–12 on the numbers rolled location 27 in order to prevent confusion.

| DIFFERENT DOUBLES™ | | |
|---|---|---|
| (1) ANY 3 PAY 10 FOR 1 | TRUE ODDS | 10 TO 1 |
| (2) ANY 4 PAY 30 FOR 1 | TRUE ODDS | 32 TO 1 |
| (3) ANY 5 PAY 120 FOR 1 | TRUE ODDS | 131 T0 1 |
| (4) ALL 6 PAY 800 FOR 1 | TRUE ODDS | 923 TO 1 |

In one example, for a player to win this wager, three of more different doubles must appear before a seven does. The same double appearing more than once has no bearing on this embodiment. A player has the choice of betting on 3,4,5, or all 6 doubles appearing before a seven. Each of these are un-related options that require a player to make a choice and separately bet each of the four choices.

The display of the six doubles (hardware) may be part of the computerized electronic system built in this table. As the doubles are rolled and punched into the electronic system the double rolled will light up automatically. Once the 1st double is rolled betting on this embodiment is not allowed.

This composite version of Different doubles allows a player to make a single bet on this embodiment that has progressive payoffs on 3,4,5, or all 6 doubles appearing prior to a seven. This wager gives the house an advantage of 3.6% overall under one analysis.

| PAYOFFS | COMPOSITE RETURN |
|---|---|
| 3 DIFFERENT DOUBLES PAY 4 TO 1 | .500 |
| 4 DIFFERENT DOUBLES PAY 7 TO 1 | .242 |
| 5 DIFFERENT DOUBLES PAY 14 TO 1 | .114 |
| 6 DIFFERENT DOUBLES PAY 100 T0 1 | .108 |
| | 96.4% |
| HOUSE ADVANTAGE | 3.6% |
| | 100% |

SWEET SIXTEEN™

COMPOSITE DOUBLES JACKPOT

Every double rolled prior to a seven appearing will apply towards the task of making 14, 15, or 16 doubles necessary to be a sweet sixteen jackpot winner. Regardless of how many times the same double is rolled, each time it appears credit is applied towards this goal.

A wager is put on the sixteen location 25. Alternatively, this could be a jackpot paid out to players who place a token in a slot 32 as described in more detail below.

The payout structure of this sweet sixteen progressive jackpot is as follows: Fourteen doubles without a seven appearing pays 7,500 to 1. Fifteen doubles (no seven) pays 15,000 to 1. Sixteen doubles (no seven) wins the sweet sixteen jackpot of 30,000 to 1. The true odds against sixteen doubles appearing before a seven is rolled are 65,535 to 1.

Prior to a player making all sixteen doubles and winning This 65,535 to 1 bet, the true odds are that a player will seven out twice after making fourteen doubles and once after making fifteen thus the statistics on this embodiment are:

| PAYOUT | | | | INCOME |
|---|---|---|---|---|
| 14 DOUBLES TWICE AT $7,500 | = | $15,000 | | $65,535 |
| 15 DOUBLES ONCE AT 15,000 | = | 15,000 | PAYOUT | 60,000 |
| 16 DOUBLES ONCE AT 30,000 | = | 30,000 | PROFIT | 5,535 |
| TOTAL PAYOUT | = | 60,000 | | |
| HOUSE ADVANTAGE 8.43% | | | | |

DOUBLE DOUBLES JACKPOT™

Jackpot bets win if the shooter gets six double doubles or five DOUBLE DOUBLES and one of the sixth doubles prior to a seven appearing. Once any double is repeated, a DOUBLE DOUBLE is scored and further repeats that particular double ceases to count. The top DOUBLE DOUBLES award is made when all six double doubles have been rolled. The true odds against rolling all six DOUBLE DOUBLES twice prior to a seen appearing are 149,100 to 1. The secondary jackpot is awarded when five DOUBLE DOUBLES plus one of the sixth, in all, eleven doubles are rolled prior to a seven appearing. The true odds here are 21,300 to 1.

The payout structure of this DOUBLE DOUBLES jackpot is as follows. The secondary jackpot (eleven of the twelve double doubles) will pay $12,500 for 1. The true odds of rolling eleven of twelve DOUBLE DOUBLES is 21,300 to 1. If the shooter continues the cycle and makes the final (twelfth) double doubles the jackpot prize is 50,000 to 1. The true odds are 149,100 to 1 against making all six doubles twice prior to a seven appearing.

The analytical odds are as follows:

Seven times out of 149,100 attempts eleven of the twelve DOUBLE DOUBLES will be rolled without a seven appearing. One of these seven times in 149,100 attempts the shooter will continue on and make the 12th and last of the DOUBLE DOUBLES without a seven appearing once. The payoff for making 11 of the 12 double doubles is 12,500 each. Once out of the seven attempts to go beyond 11 of the 12 the shooter will be successful and complete the cycle of 12 of 12 DOUBLE DOUBLES. When this occurs the jackpot prize of $50,000 is won.

| PAYOFFS | | | INCOME |
|---|---|---|---|
| 6 AT 12,400 EACH | = $75,000 | | $149,100 |
| 1 AT $50,000 EACH | = $50,000 | PAYOUT | 125,000 |
| | 125,000 | HOUSE ADVANTAGE | 24,100 |
| The house advantage is 16.16%. | | | |

In order to track the Sweet sixteen, FIG. 1 shows a set of six sixteen location to track each player's (players 1–6 on each side) bets, and doubles number location 40 to mark and display the number of doubles rolled. Above this is a numbers location 27 to display each of the numbers as they are rolled. Similar locations can be provided for Double-Doubles.

The numbers location can also accommodate doubles indicators showing that each given number has been rolled as a double and how many times. This may be a chip of one shape or color for non-doubles (shown in FIG. 1 as a round chip 29) and a separate shape or color (shown in FIG. 1 as a square chip 30) for doubles caped with a numeral 30 which numeral indicates the number of time the double or non double number has been rolled. In one embodiment shown in FIG. 2 half of doubles display location 40 lights up when one double is rolled. The other half of the location 40 lights up when the doulbe is rolled a second time (double-doubles). Hence the 1-1 box under 40 would light up half way when two ones were rolled then the other half would light up when the second 1-1 was rolled before a seven. This would apply for all doubles combination.

An electronic alternative would be to have a numeric keyboard to light up various combinations. The player has a choice of wagering on any one or all of the six doubles possible for a player to win, the double(s) chosen must appear twice before shooter rolls a seven. Once a double (hard way) is rolled the dealer may punch an appropriate key twice which in turn lights up one half of that particular double. For example: if two five's are rolled the dealer will punch key number 5 twice. Once two fives are rolled again the dealer punches key no. 5 twice more lighting up the other half of the electronics light double five. This signifies any player who bet on this particular double is a winner.

TWICE IS NICE™

For a player to win this embodiment any one of the six different doubles (hard ways) that can be rolled on a pair of dice must appear twice prior to a seven being rolled.

Players can wager on this embodiment at any time during a shooter term as long as the first double (hard way) has not been made. Once the first double (hard way) has been rolled there can be no more wagers allowed.

Pete and Repeat™

Pete and Repeat™ wagers provide for a payout in the event that anyone selected 'hard way' is rolled twice prior to the roll of the seven. Additionally, having two 'hard ways' of the same type rolled sequentially could have a higher payout.

A player can bet on any double during each shooters term as long as the double chosen has not appeared once. Since chips 29 & 30 or lights mark the rolling of doulbes, this is already taken into account The true odds of the same double (hard way) appearing twice before a seven is rolled is 48 to 1. The payoff to participants is 45 to 1.

Three pete wagers may be made on location 40 shown on FIG. 2 for example a pete wagers on hard 6 would be in the 3-3 location under location 40 and a payout made if two hardway sixes were rolled before a seven.

Jackpots:

A progressive jackpot may be provided on the game as by providing a payoff to those players on the initial Four the Money Wager where all combinations other than a 7 are rolled prior to rolling a seven. This particular jackpot is a fraction of the entire jackpot and is financed according to a specific bet made by every player when they sit at the table. When the player gets up regardless of how long they remain at the table they forfeit that wager and that wager is only made if and when they played a Four the Money Wager.

It is forfeited the first time that they fail to make a Four the Money Wager at which time they can replace the bet if they desire. Although in the preferred embodiment this special wager is only made once and in other embodiments it can be made as often as desired by the casino or other operation in order to increase the payoff on the large wager. One way of keeping track of this bet would lie in taking the initial bet and giving the player a token and its place which would go on a counter in front of that player until such tie as that player fails to make a Four the Money Wager. This could serve two purposes. One, it would allow for a jackpot and also it would increase the incentive of the players to continually make Four the Money Wagers.

This form of a jackpot has envisioned other jackpot methods such as the provision of a block or slot for a token play for every roll or every initial four the money roll. This could be made without parting from the inventive concept embodied herein. This could go into a jackpot which paid out only when a forty o lordy or multiple doubles or similar statistically remote possibility occurred.

Similarly, less than all combinations than the seven could be provided for in order to have a jackpot payout without departing from the inventive concept embodied herein. Similarly, the payout could be on multiple rolls of a single kind for a partial payoff such as the Pete and Repeat multiple rolls of seven in a row, etc.

One novel method of determining a payout from a jackpot would be to provide that a jackpot fraction which is determined by rolling the dice and taking the resulting number and dividing by twelve. This fraction would be multiplied times the total jackpot amount to get a percentage of the total jackpot to be paid.

HOW TO PLAY

After each roll the dealer will control the dice until all players have had a chance to complete additional bets on propositions or change their odds around to their choosing. In the stand up version shown in FIG. 1, the dice may be held and rolled by a player.

A shooter may be able to play from the 'don't' line or may be required to make a minimum bet on money wager. The other players are not required to make this or any other bet. The various bet sizes allowed on a "FOUR THE MONEY WAGER"™ will vary from casino to casino.

The amount of odds a player is allowed to take will vary. Either 5 or 10 times odds will typically be available based on their money wager ("FOUR THE MONEY WAGER".™) If a non-shooter does not make a "FOUR THE MONEY WAGER"™ they cannot take odds on any of the numbers (2 thru 12). These numbers represent all of the numbers (except seven) that can be rolled on a pair of dice. A player can mix these odds in any matter of mixture they choose as long as they do not exceed the 10 times (or other times limit) money wager amount.

Figure 4B:
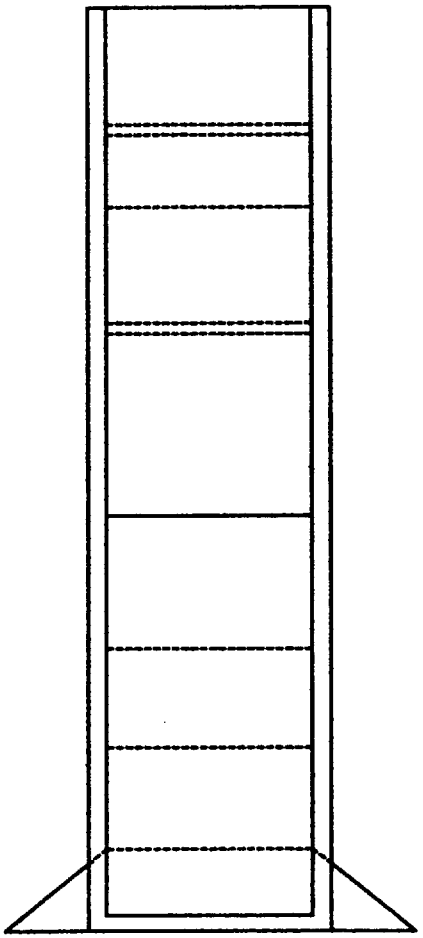
FIG. 4*b* is a rear view of the device shown in FIG. 4.
Figure 4A:
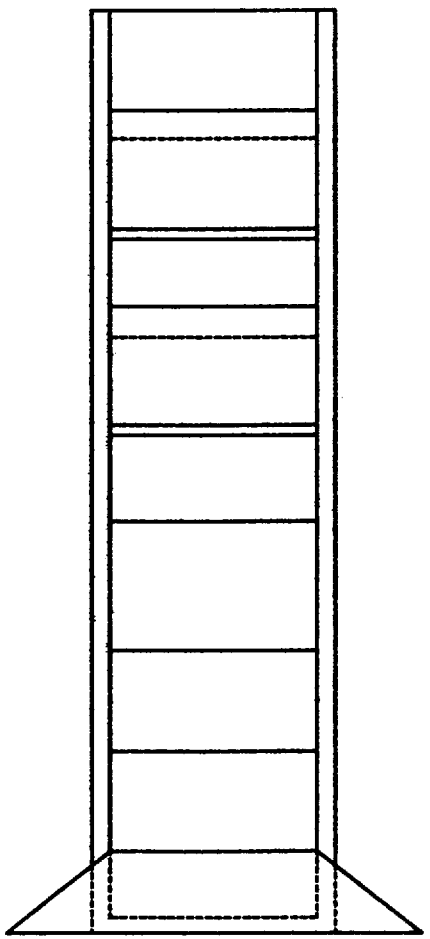
FIG. 4*a* is a front view of the device shown in FIG. 4
Figure 4:
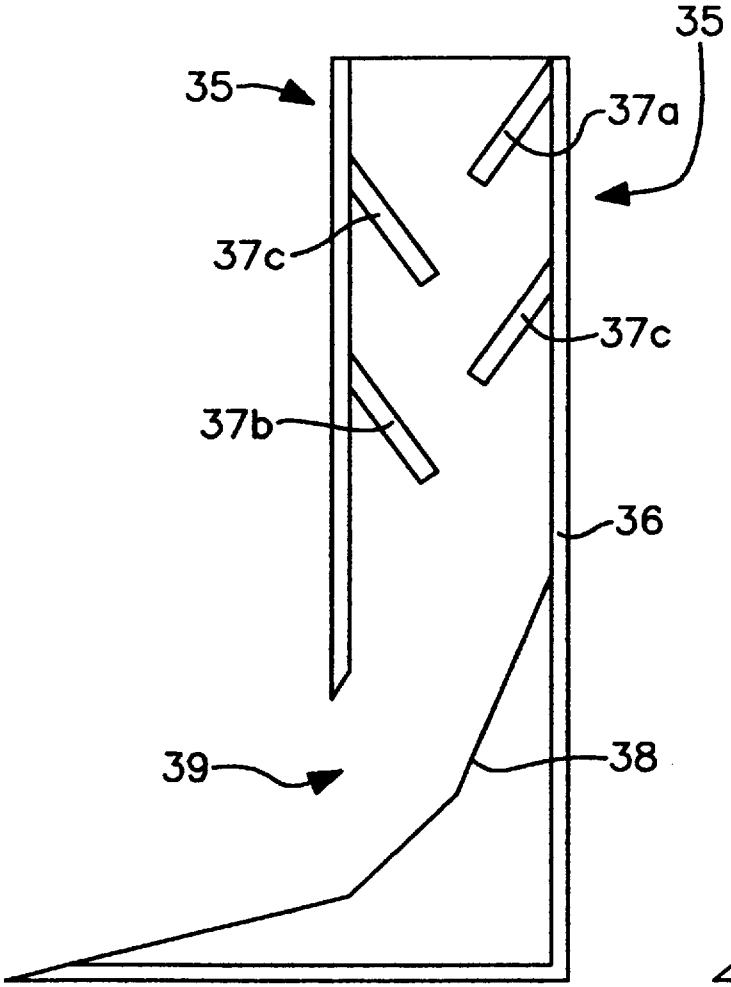
FIG. 4 is a cross sectional side view of a device for generating randomized dice throws where the players are not able to throw the dice.

In the sit down version shown in FIG. 2, a "SHUTE™" 35 as shown in FIG. 4 may be passed from Player to Player as they become the shooter. "THE SHUTE"™ is a 3 inch diameter squared tube 36 that is one foot tall. Its function is to trip the dice off platforms 37 bouncing the dice from the top platform 37*a* to the bottom platform 37*b* via several intermediate platforms 37*c* as they drop down "THE SHUTE"™ tube 36. The dice free fall the last 5 inches onto an angled base 38 that creates a tumbling motion. At the bottom of the angled base 38 is an opening 39 allowing the dice to tumble out onto the table area.

THE TABLE

The size of the table in a sit down version using a shute may be 7×3½ feet, and is shaped similar to a blackjack table as shown in FIG. 2. This is identical to the table in FIG. 1 but for a sit down version. Built in, is a computerized electronic controlled board designed to light up certain embodiments. These lit embodiments will be covered by a plexiglass top to protect the electronic lighted areas of this table.

The table has player locations 33 which allow the player to maintain all odds bets locations 5–14, for the money bets and some 'side bets' such as fourty-o-lordy 4 and all or nothing locations 3. These bets may also be removed to the locations for 24 if those locations are divided and numbers 2, 3, 11 and 12 are added in the fashion shown in historic craps-dice games. The player locations 2–14, summarized as player locations 33 may be counter-sunk into the table 41 or have raised edges 42 in order to prevent the dice (not shown) from knocking the bets into the wrong locations as they are flung across the table. Similarly, the bets may be numerically marked within these locations 33 with numeric displays or token displays and held by the house pending a payout.

Other features built into the table include drink and ashtray holders, chip rack holder and a 4×4 inch cutout for an electric counter.

The Shute is provided, particularly in a sit down version to insure a good roll of the dice. To expedite play and assure that the several propositions are operating by the rules, an electrical display system is preferably incorporated into the table. The dealer will enter the Start of Roll and each roll (die by die) and the appropriate display lights will advise players and the dealer of awards to be made and bets to be swept.

COMPUTERIZED ELECTRONIC EMBODIMENTS

Any portion of the disclosed invention may be handled electronically and displayed on a computer screen or electronically controlled on this table. Examples given for electronic control on the table are:

(1) Peat and Repeat (2) Different Doubles (3) A 4×4" computerized counter to register the number of rolls each player makes prior to seven out (4) Ten of the twelve 1¾ inch squares that contain numbers 2-3-4-5-6-8-9-10-11-12 centered vertically in front of each player are keyed into the electronic system to light up as keyed into the computerized system.

The electronic components will be controlled by a key board system made easily accessible to the dealer operating the table. It will contain the following described keys:

(1) Keys numbered one thru six to record and light all numbers rolled (except seven).

(2) This system will count and light up the number of rolls a player rolls prior to seven out. It is designed to count and light from one to forty in the 4×4 inch square area located in the center of the table.

(3) Once a player rolls a seven a cancel key will clear out all of that shooters activity.

(4) a switch to activate and shut down the system.

(5) A retract key that will cancel only the last activity recorded in it. This will be used only on rare occasions to retract an error if made by the dealer.

MATHEMATICAL ANALYSIS OF FOUR THE MONEY

1. Introduction

This report presents the mathematical analysis of "Four the Money" a new casino table game. Four the Money is a game played on a Black jack table game. "Four the Money" is a game played on a Black-Jack style table. The game uses a pair of dice, with the players offered a variety of propositions involving the successive rolls of the dice by the designated shooter.

2. Propositions and House Advantage

2.1 "FOUR THE MONEY"

The Shooter must wager on this proportion in order to play. For all other players the wager is optional. For both the shooter and all other players the wager, is optional. For both the shooter and all other players, the ODDS bets are available only if a bet is made on "FOUR THE MONEY".

"FOUR THE MONEY" requires that four consecutive rolls are made without a "7" coming up. The wager is paid at even money (1.1). Since the probability of winning is 0.4822, the house advantage is 3.55%. Players must wager on "FOUR THE MONEY" prior to the shooter starting his turn.

2.2 ODDS

Any player who bets on "FOUR THE MONEY" is entitled to play the ODDS bets on individual numbers from 2 through 12. To win, the selected number must be rolled before a "7". The payout are at 6-1 on 2 and 12, 3-1 on 3 and 11, 2-1 on 4 and 10, 3-2 on 5 and 9. Since these are at true odds, the house has no advantage on them. They serve as an incentive for players to play "FOUR THE MONEY", and players can bet up to 10 times the "FOUR THE MONEY" bet. If a player bets the full 10 times allowable, the house advantage of the combined "FOUR THE MONEY" wager and ODDS bets is reduced to 0.31% of the total at stake.

2.3

This is a wager that a specific Double (Hard Way) will be thrown twice before any "7". The true odds are 48-1 and the payout is at 45 for 1 (44-1). The house advantage is 4/49 or 8.2%. Players can bet on any double at any time, so long as that double has not appeared once.

2.4 "DIFFERENT DOUBLES"

These are wagers that three, four, five or six "DIFFERENT DOUBLES" will appear before a "7". All bets must be down before any double is rolled. The wagers are unrelated to each other, so the player may bet any of the propositions.

The payout for 3 "DIFFERENT DOUBLES" is 9-1 (10 for 1). True odds are 10-1, resulting in a house advantage of 9.1%.

The payout for 4 "DIFFERENT DOUBLES" is 29-1 (30-1). True odds are 32-1 resulting in a house advantage of 9.1%.

The payout for 5 "DIFFERENT DOUBLES" is 119-1 (120-1). True odds are 131-1 resulting in a house advantage of 9.1%.

The payout for 6 "DIFFERENT DOUBLES" is 799-1 (800-1). True odds are 923-1 resulting in a house advantage of 13.4%.

2.5 "FORTY O'LORDY"

This bet pays off if the shooter rolls 10,20,30 or 40 times (or more) without a "7" coming up. Players may bet individually on any one or more of the four selections.

The payout on 10 or more is 4-1 (5 for 1). The true odds are 5.19-1. The house advantage is 19.2%

The payout on 20 or more is 29-1 (30 for 1). The true odds are 37.3-1. The house advantage is 21.7%

The payout on 30 or more is 179-1 (180 for 1). The true odds are 236.3-1. The house advantage is 21.1%

The payout on 40 or more is 1,199-1 (1,200 for 1). The true odds are 1,468-1. The house advantage is 18.3%

2.5.1 OPTIONAL "FORTY O'LORDY" PROPOSITIONS

For 12 rolls without a 7, the player would be paid 8 for 1, which gives the house an 11% advantage, since the true odds are 8-1.

For achieving 24 rolls, the player would be paid 70 for 1, (69-1) which gives the house an advantage of 12.5% since the true odds are 79-1.

For 32 rolls, the payout would be 300 for 1 (299-1), which gives the house an advantage of 12.3% since the true odds are 341-1.

For 40 rolls, the payout would be 1300 for 1 (1,299-1) to give the house an advantage of 11.5%. The true odds are 1,468-1.

2.6 "ALL OR NOTHING AT ALL"

Shooter is required to roll all numbers from 2 through 12 (except 7) before rolling a seven, True odds are 195-1 and the winner is paid 175-1, thereby giving the house an advantage of 9.7%.

2.7 "DOUBLE-DOUBLES JACKPOTS" (Optional)

JACKPOT bets win if the shooter gets 6 "DOUBLE-DOUBLES" or 5 "DOUBLE-DOUBLES" Plus ONE (of the sixth "DOUBLE"). When a "DOUBLE" is repeated, a "DOUBLE-DOUBLES" is scored and added.

Repeats of that particular "DOUBLE" is not counted. The top "DOUBLE-DOUBLES" have been hit. From a computer simulation in which thirty million shooters were tested, it was found that 1,652 were able to reach all six "DOUBLE-DOUBLES", while 1,414 rolled out after 5 "DOUBLE-DOUBLES" Plus ONE.

A typical award schedule for "DOUBLE-DOUBLES" might pay 100,000 for 1, with the consolidation award for 5 "DOUBLE-DOUBLES" Plus ONE paying 2,500 for 1. The total payout on 30,000,000 bet units would 27,335,000 resulting in a house advantage of 8.9%.

3. Odds stated herein were derived analytically except for "ALL OF NOTHING" and he optional "DOUBLE-DOUBLES" propositions which were derived by simulation or millions of trials. While these odds can be derived analytically, the process is quite lengthy and tedious. The software programs for these are quite simple and are available upon requests by regulatory bodies to Computer Flyers.

OPTIONAL FEATURES

1. "FORTY O'LORDY"

12 rolls no seven players will be paid 8 for 1. This gives the house and 11% advantage, since the true odds are 8 to 1.

24 rolls no seven, players will be paid 70 for 1. This gives the house an 12.5% advantage since the true odds are 79 to 1.

32 rolls no seven, players will be paid 300 for 1. This gives the house an 12.3% advantage since the true odds are 341 to 1.

2. "DIFFERENT DOUBLES"

This composite version of different doubles allows a player to make a single bet on this embodiment that has a progressive payoff on 3,4,5 or all 6 doubles appearing prior to a seven showing. The house has an advantage of 3.67.

| PAYOFFS | COMPOSITE RETURN | |
|---|---|---|
| 3 DIFFERENT DOUBLES PAY 4 TO 1 | .500 | |
| 4 DIFFERENT DOUBLES PAY 7 TO 1 | .242 | |
| 5 DIFFERENT DOUBLES PAY 14 TO 1 | .114 | |
| 6 DIFFERENT DOUBLES PAY 100 TO 1 | .108 | |
| | 96.4% | RETURN |
| | 3.6% | VIC |
| | 100% | |

3. "DOUBLE DOUBLES JACKPOT"

Jackpot bets win if the shooter gets six double-doubles or five double-doubles and one of the sixth doubles prior to a seven appearing. Once any double is repeated, a double-double is scored and further repeats of that particular double cease to count the top double-doubles have been rolled. The true odds against rolling all six doubles twice prior to a seven appearing are 149,100 to 1. The secondary jackpot is awarded when five double-doubles plus one of the sixth, in all eleven doubles. The true odds here are 21,300 to 1.

The payout structure of this double-doubles jackpot is as follows. The secondary jackpot (eleven of the twelve double-doubles) will pay $15,000 for 1. The true odds of rolling 11 of 12 doubles-double is 21,300 to 1. If the shooter continues the cycle and makes the final (Twelfth) double-doubles the Jackpot prize is 75,000 to 1. The true odds are 149,100 to 1 against making a six doubles twice prior to a seven appearing.

4. The analytically odds areas follows seven time out of 149,100 attempts eleven of the twelve double doubles will be rolled without a seven appearing, out of these seven time in 149,100 attempts will the shooter continue on and make the 12th and last of the double-doubles without a seven appearing first. The payoff for making 11 of the 12 double-doubles is 12,500 each. Once out of the seven attempts to go beyond 11 of the 12 and will complete the cycle of 12 of 12 double-doubles, when this occurs the jackpot prize of $50, 000 is won.

| PAYOFFS | | | INCOME |
|---|---|---|---|
| 6 at $15,000 each | = | $75,000 | 149,100 at $9.00 = $149,000 |
| 1 at $50,000 will | = | $50,000 | Payout = =$140,000 |
| TOTAL PAYOUT | | $125,000 | HOUSE ADVANTAGE $125,100 |
| THE HOUSE ADVANTAGE IS 16.16% | | | |

5. "HOP BETS"

Over seven—there are 15 winning combinations and 21 losing. The true odds are 7 to 5. Player paid 6 to 5.

Under seven—same as above.

Seven—there are 30 losing and 6 winning combinations. True odds are 5 to 1. Player paid 4 to 1.

Any crap—there are 32 losing and 4 winning combinations, True odds are 8 to 1. Player paid 7 to 1.

Two aces—there are 35 losing and only one winning combinations, true odds are 35 to 1. Player paid 30 to 1.

Two sixes—same as two aces.

Jackpot bets would vary according to the statistical payout probabilities and jackpot account amounts.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A method of playing a betting game comprising the steps of:

a) choosing a minimum number within a range or numbers generated from the roll of at least one dice means;

b) choosing a maximum number within a range of numbers generated from the roll of at least one dice means, said maximum number being different from said minimum number;

c) choosing at least one target number between said minimum number and said maximum number;

d) choosing at least one desired count number representative of the number of times the dice means are to be rolled generating numbers prior to generating said target number, said desired count number being at least equal to 3;

e) generating dice rolls using the at least one dice means;

f) counting the actual number of dice rolls by providing an actual count number of said dice rolls that generate numerical values between said minimum number and said maximum number, comparing an actual numerical value generated by each dice roll with at least one said target number, adding a count number to said actual count number if said actual numerical value does not equal said at least one target number, said actual count number being made independently of the actual numerical value displayed by the at least one dice means, except to the extent of determining whether an actual numerical value generated by a dice roll is equal to the at least one target number; and g) providing a (1) pay-out or (2) win when said actual count number is equal to said at least one desired count number.

2. The method of claim 1 wherein the desired count number is at least four.

3. The method of claim 1 is wherein the dice rolls are generated using at least one dice means for generating a number associated with a multi sided structure having a different number on each separate side.

4. The method of claim 3 wherein the at least one dice means further comprises at least two dice means and wherein the total of the two dice means is used as the numerical value.

5. The method of claim 4 wherein the dice means comprises at least one dice.

6. The method of claim 5 further comprising a second dice and wherein the total of the two dice is determined to determine the numerical value of the dice rolls of step e.

7. The method of claim 6 wherein the first and second dice are six sided dice numbered from 1 to 6.

8. The device of claim 4 wherein the at least one target number is 7, the minimum number is 2 and the maximum number is 12.

9. The invention of claim 1 further comprising the step of placing at least one odds wager on an odds bet number between the minimum number and the maximum number, on the probability that the odds bet number will be generated prior to the at least one target number being generated.

10. The invention of claim 9 wherein the amount of the at least one odds wager is a chosen multiple of the amount of the money wager.

11. The invention of claim 10 wherein a payoff is made on the odds wager based on true odds of the odds bet number being reached prior to the at least one target number when the odds bet number is generated prior to the at least one target number.

12. The invention of claim 9 further comprising the steps of (i) placing an odds wager on the probability that one odds bet number will be reached prior to generating the at least one target number and (ii) making a payoff based on true odds of the odds bet number being reached prior to the at least one target number when the odds bet number is reached prior to the at least one target number.

13. The invention of claim 1 wherein step (f) is continued until the at least one target number is reached and step (d) comprises the additional step of choosing at least one second desired count number of dice rolls which is greater than the at least one desired count number chosen, and making a wager on the at least one second desired count number and paying the wager if the at least one second desired count number is reached prior to generating the at least one target number.

14. The invention of claim 13 wherein the at least one second desired count number is a multiple of the desired count number.

15. The invention of claim 13 wherein the payout upon reaching the at least one second desired count number is greater than the payout on reaching the at least one desired count number.

16. The invention of claim 1 further comprising the steps of:

h) entering an initial amount between zero and a chosen maximum initial jackpot amount in a jackpot account;

i) placing a jackpot wager;

j) adding at least a first portion of the jackpot wager to a jackpot account;

k) withholding the payout of the jackpot wager until after the at least one desired count number is reached prior to the at least one target number;

l) paying out at least a jackpot portion of the jackpot account to at least one player who has made a jackpot wager.

17. The invention of claim 16 comprising requiring the at least one player to have wagered that the desired count number would be reached prior to the at least one target number before paying out at least a portion of the jackpot account.

18. The invention of claim 16 wherein step (l) further comprises the additional step of requiring the at least one player to have wagered that the desired count number would not be reached prior to the at least one target number before paying out at least a portion of the jackpot account.

19. The invention of claim 16 wherein step (k) further comprises the additional step of withholding payment from the jackpot account until at least two sets of double doubles have been reached.

20. The invention of claim 19 wherein step (k) further comprises the additional step of withholding payment from the jackpot account until at least three double doubles have been reached.

21. The invention of claim 19 wherein step (d) further comprises the additional step of withholding payment from the jackpot account until all double doubles have been reached.

22. The invention of claim 16 wherein step (d) further comprises the additional steps of:

(I) determining what percentage of the jackpot will be paid out by:

(A) generating a jackpot random number between the chosen maximum and the chosen minimum number;

(B) dividing the jackpot random number by the chosen maximum number to obtain a jackpot fraction;

(C) multiplying the total jackpot account by the jackpot fraction to obtain the amount of the jackpot to be paid out.

23. The invention of claim 16 wherein step (k) further comprises the additional steps of maintaining the count on the number of repetitions until the at least one target number is reached and choosing at least one second desired count number of dice rolls which is greater than the at least one desired count number and withholding payment from the jackpot account until the at least one second desired count number is reached.

24. The invention of claim 23 further comprising the steps of:

(I) determining what percentage of the jackpot will be paid out by:

(A) generating a jackpot random number between the chosen maximum and the chosen minimum numbers;

(B) dividing the jackpot random number by the chosen maximum number to obtain a jackpot fraction;

(C) multiplying the total jackpot account by the jackpot fraction to obtain the amount of the jackpot to be paid out.

25. The invention of claim 1 further comprising the steps of:

(h) placing a don't wager on a don't location;

(i) after the generation of a random number other than the target number moving the don't wager to the random number so that the generated random number becomes the don't wager number;

(j) paying the don't wager if the at least one target number is generated before generating the don't wager number.

26. The invention of claim 1 further comprising:

(h) placing an all or nothing wager;

(i) paying the all or nothing wager if all numbers between the predetermined minimum and predetermined maximum are generated before the at least one target number is reached.

27. The invention of claim 1 wherein step (f) is continued until the at least one target number is reached and thereafter at least one second desired count number is chosen and wherein the invention further comprises:

I) determining a matching amount as a multiple of the amount of a money wager;

ii) placing the matching amount into a jackpot account each time a number is generated;

iii) paying the jackpot with at least one wager if the at least one second desired count number of repetitions is reached prior to the at least one target number being generated.

28. The invention of claim 27 further comprising the step of removing at least a portion of the jackpot amount if the at least one target number is generated prior to reaching the at least one second desired count number.

29. The invention of claim 1 further comprising the steps of (1) placing a hop wager on a hop number between the chosen minimum and the chosen maximum numbers; (2) paying the hop wager if the hop number is generated on the next generation of a random number.

30. The invention of claim 1 wherein step (f) of providing an actual count number is continued until the at least one target number is reached and thereafter choosing at least one second desired count number and wherein the invention further comprises:

i) placing at least one successive wager prior to the initial generation of a number;

ii) paying a progressively larger amount on money wagers after the at least one second desired count number is reached to players placing the at least one successive wager.

31. The method of claim 1 further comprising the step of:

(h) placing a wager into a jackpot account;

(i) paying the jackpot account to at least one player upon the reaching of the desired count number before the generation of the target number.

32. The method of claim 1 further comprising the step of:

(h) placing a wager into a jackpot account;

(i) setting an event wherein said event is the generation of at least one number prior to the generation of the target number;

(j) paying the jackpot account to at least one player upon the happening of the event.

* * * * *